United States Patent [19]

Verlinden

[11] 3,952,904

[45] Apr. 27, 1976

[54] CONTAINER, PARTICULARLY A BEER BARREL

[76] Inventor: Marius Alphonsus Johannes Verlinden, 1061, Landrestraat, The Hague, Netherlands

[22] Filed: Sept. 3, 1974

[21] Appl. No.: 502,469

[30] Foreign Application Priority Data

Sept. 12, 1973 Belgium ..... 135571

[52] U.S. Cl. ..... 220/5 R; 220/67

[51] Int. Cl.[2] ..... B65D 7/02; B65D 7/42

[58] Field of Search ..... 220/5 R, 3, 253, 315, 220/66, 67; 215/1 C

[56] References Cited

UNITED STATES PATENTS

| | | | |
|---|---|---|---|
| 2,962,182 | 11/1960 | Rossheim | 220/3 |
| 3,199,712 | 8/1965 | Nurkiewicz | 220/3 |
| 3,372,828 | 3/1968 | Pechacek et al. | 220/75 X |
| 3,712,497 | 1/1973 | Jones | 220/66 X |
| 3,780,901 | 12/1973 | Pechacek | 220/315 |

*Primary Examiner*—William Price
*Assistant Examiner*—Steven M. Pollard
*Attorney, Agent, or Firm*—Woodhams, Blanchard and Flynn

[57] ABSTRACT

Container, particularly a beer barrel, with a first part, made of plastics in the form of a vessel, open at one end, the part merging in the vicinity of the open end via a shoulder into a cylindrical part with enlarged diameter, which receives with a close fit a cylindrical end wall portion of a second part forming a closure for said end, means being provided for rigidly interconnecting the cylindrical part with enlarged diameter of the first part and the cylindrical end wall portion of the second part, such that a sealed transition between the shoulder and the peripheral portion of the end wall is obtained.

10 Claims, 5 Drawing Figures

CONTAINER, PARTICULARLY A BEER BARREL

BACKGROUND OF THE INVENTION

My invention relates to a fluid-tight container, such as beer barrels, comprising a first part, made of plastics in the form of a vessel, open at one end, and a second part, also of plastics, fitted sealingly in said open end of said first part and forming a closure for said end.

Such containers are known per se. They are advantageous in that they can be formed by injection moulding and in that by a simple modification of the die used in injection moulding it is possible to mould bodies of containers having the same diameter but different lengths, so that by a combination of various bodies with end parts of the same dimensions, containers of different volume each comprising only two parts, can be obtained.

Moreover such containers can be manufactured with a cylindrical shape corresponding with the shape of the conventional steel or aluminium containers which for the user is advantageous in that the transport and storage facilities need not be adapted to the new containers.

In such containers the area in which the cylindrical body merges into the end part is the heaviest loaded part. The dimensioning and construction of this area is no problem as far as the end part which forms one piece with the body is concerned, since during the injection moulding, additional material can be provided in these areas which are heavily loaded so that the required strength is ensured. A greater problem is, however, the fact that the second end part must be sealingly disposed within the open end of the body of the vessel, so that not only must sufficient strength be provided in this region, but the junction between the two parts must be permanently gas and liquid-tight.

SUMMARY OF THE INVENTION

It is an object of the present invention to provide a solution for this problem. According to the invention the first part merges in the vicinity of the open end via a shoulder into a cylindrical part with enlarged diameter, which receives with a close fit a cylindrical end wall portion of the second part, means being provided for rigidly interconnecting the cylindrical part with enlarged diameter of the first part and the cylindrical end wall portion of the second part such that a sealed transition between the shoulder and the peripheral portion of the end wall is obtained.

In this way it is ensured that in the assembled condition an effective seal between the two parts, which preferably contact each other under pre-stress, is obtained, in combination with a sufficient strength of the container at this point.

The means for interconnecting the cylindrical part with enlarged diameter and the cylindrical end wall portion of the second part comprise preferably a number of supersonically formed welds, distributed along the circumference of these parts. This leads to a very strong interconnection and an easy manufacture of the container; the second part can be pressed into the open end of the first part with a predetermined pressure, whereafter the welds interconnecting the parts, are formed.

Preferably the peripheral portion of the end wall and the shoulder are shaped such as to provide a space housing a sealing ring when the parts are assembled.

This sealing ring may be compressed more or less before the welds are formed, retaining its sealing properties; the resulting variation of the net volume makes it possible to compensate within a certain range for volume variations resulting from variations in the dimensions of the two parts by measuring the volume of the container before the parts are welded together and compressing the sealing ring more or less until the container has the correct volume, whereafter the welds are formed. The means for connecting the two parts may also be obtained by holes being formed in the cylindrical part with enlarged diameter and the cylindrical end wall portion of the second part at identical angular positions in such a way that, when the peripheral portion of the end wall contacts the shoulder of the first part, the centerline of a bore in the second part lies below the centerline of a bore in the first part, while in the assembled condition of the vessel a pen-shaped part, manufactured from hard material is inserted into at least a number of the opposite bores, whereby the bores are then substantially coaxial.

When the second part is introduced into the open end of the first part and pressure is applied to the second part, aligning the two centerlines, the insertion of the pens ensures a correct fit, particularly when the assembling is done in such a way that the end part is pressed into the open end of the first part when the latter is at a higher temperature so that on cooling the first part shrinks around the second part, resulting into an excellent sealing combined with adequate strength.

It is possible that the shoulder of the first part and the peripheral portion of the end wall enclose in the non-assembled position, as seen from the inside towards the outside, an acute angle. In that case no sealing ring is used between the two parts, the deformation of the sharp edges serving to obtain a correct sealing. The two parts might also be interconnected by means of a glue applied to the edge surfaces, a circumferential groove being formed in one of the edge surfaces at some distance from the inner wall, to take up excess glue.

SURVEY OF THE DRAWINGS

DESCRIPTION OF PREFERRED EMBODIMENTS

Figure 1:
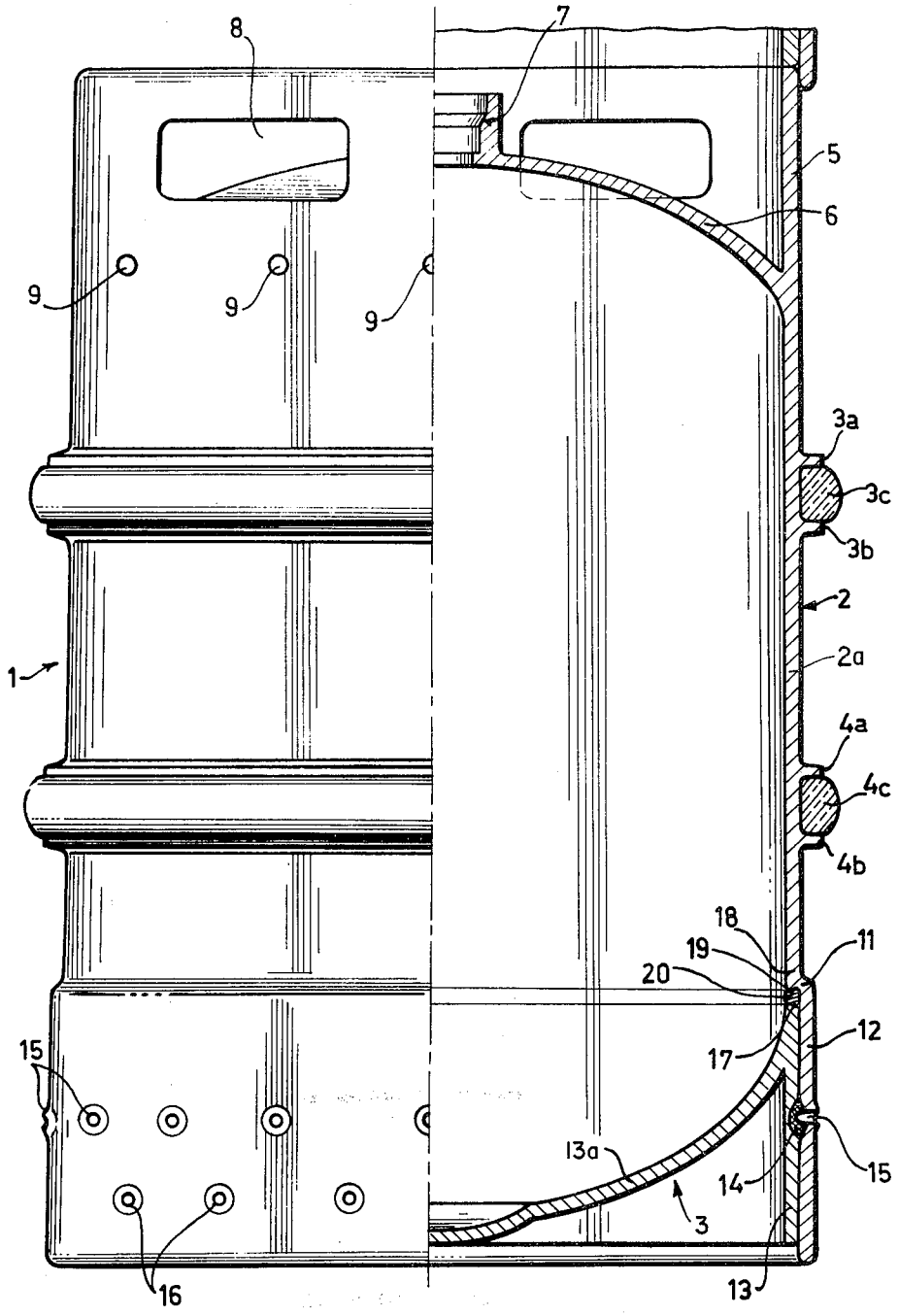
FIG. 1 shows to the left an elevation view and to the right a longitudinal section view of a container according to the invention, in the form of a beer barrel.

In FIG. 1 the container, a beer barrel, as a whole is denoted by the reference numeral 1. It consists of a first part, or body, 2 constituting the body of the barrel, in the form of a vessel open at one end and a second, or end, part 3 disposed within the open end of the first part. The two parts are made of synthetic plastics by injection moulding.

The part 2 comprises a peripheral wall 2*a* which in its cylindrical intermediate portion is provided with integral rolling ribs 3*a*, 3*b*, 4*a*, 4*b*. The space between the rolling ribs 3*a* and 3*b* and the space between the rolling ribs 4*a* and 4*b* may be filled by annular bands 3*c*, 4*c*, for instance of rubber, which in effect form tyres when the barrel is rolled.

Within the region bounded by the upper end portion 5 of the cylindrical wall 2*a* of the body 2 of the barrel, is an arched closure 6, integral with the body of the vessel, with the bung hole 7 which in the usual way may be provided with an internal screw thread. The end portion 5 is provided with openings 8 serving as hand holes and with holes 9 through which rinse water can flow away when the vessel is cleaned.

The cylindrical wall 2*a* of the part 2 is of substantially constant thickness throughout its length (neglecting the ribs 3*a*, 3*b*, 4*a*, 4*b*) and is of uniform diameter from its upper edge down to a transition region 11 spaced above the lower end of the part 2. Over the region 11 the cylindrical portion of wall 2*a* above this region merges with a substantially cylindrical lower portion 12 below this region. The diameter of lower portion 12 is enlarged with respect to that of the cylindrical wall 2*a* above region 11.

The end part 3 comprises a generally bowl-shaped end wall portion 13*a*, which forms the lower end wall of the barrel, and an integral substantially cylindrical peripheral wall 13 extending downwardly from the peripheral region of the end wall portion. The peripheral wall 13 of the end part 3 fits within the enlarged diameter portion 12 of the wall of part 2. The latter portion 12, and the peripheral wall 13 may be tapered slightly towards the transition region 11; this is not visible in the figure.

A number of ultrasonically formed spot welds 15, 16 is arranged in two rows along the circumference of the cylindrical portion 12 and the peripheral wall 13; they serve to rigidly interconnect these parts at a number of points. Such a spot weld is formed by pressing a (not shown) pen-shaped welding tool, which is energized such as to vibrate with a supersonic frequency, against the outer surface of the portion 12. The generated heat melts the plastics material of, first, the portion 12 and thereafter of the peripheral wall 13 in a region (indicated by the reference numeral 14) around the welding tool; these plastics materials flow into and through each other and after withdrawal of the tool and the hardening of the material a perfect and very strong interconnection is obtained. By using suitable machinery, a number of spot welds can be formed simultaneously.

The edge 19 of the shoulder 18 between the part 2 and the enlarged diameter portion 12 is directed outwardly and upwardly; the peripheral edge 17 of the part 3 is directed outwardly and downwardly. These edges 17 and 19 together with the inner wall of the enlarged diameter portion 12 thus define a space for accommodating a sealing ring 20. This ring which, in its uncompressed state, can have a diameter of 6 mm may be compressed 15–35%; the resulting variation of the distance between the arched part 6 and the bowl-shaped end wall 3 can be used to compensate for variations in the net volume of the finished barrel. During manufacturing the part 3 is thereto pressed into the part 2 to such an extent that the barrel has the correct net volume whereafter the spot welds are made.

Figure 2:
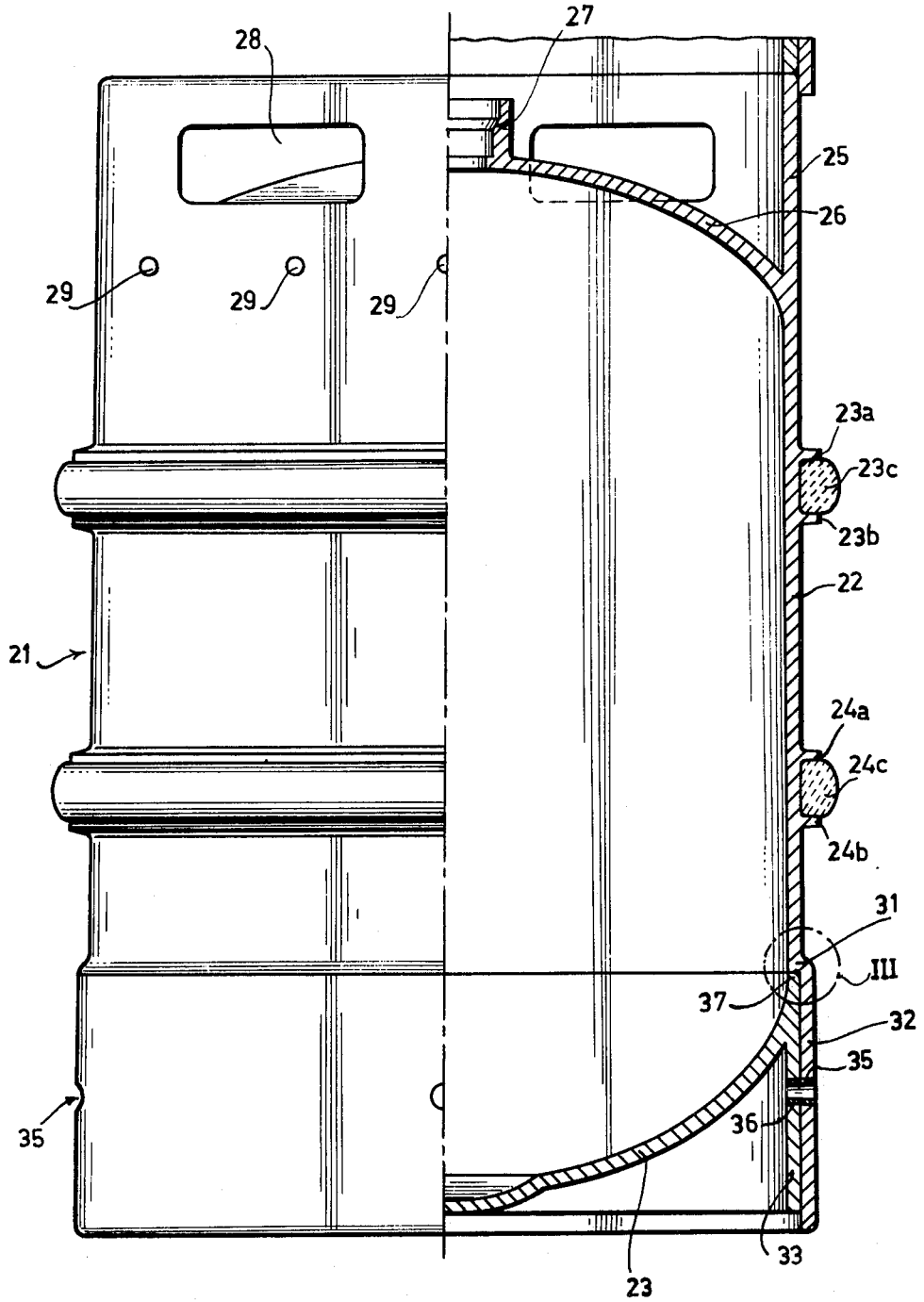
FIG. 2 shows a similar view of another embodiment of a container according to the invention.

FIG. 2 shows another embodiment of a beer barrel according to the invention. This container, as a whole denoted by the reference numeral 21 is in many aspects similar to the one described hereinbefore. It comprises the first part 22 and the second part 23; the part 22 carries the rolling ribs 23*a*, 23*b* and 24*a*, 24*b* with the bands 23*c*, 24*c* respectively. This barrel, too, comprises an upper end portion 25 with the arched closure 26 and the bung hole 27. Opening 28 and rinse openings 29 are provided too.

This barrel further comprises the bowl shaped end wall portion 23 with the cylindrical peripheral wall 33. This wall 33 fits within the enlarged diameter portion 32 of the peripheral wall of part 22.

A number of bores 35, 36 are made in the wall portions 32 and 33 respectively, each bore 35 being aligned with a corresponding bore 36 and the aligned bores receiving corresponding retaining members as is explained below.

Figure 3:
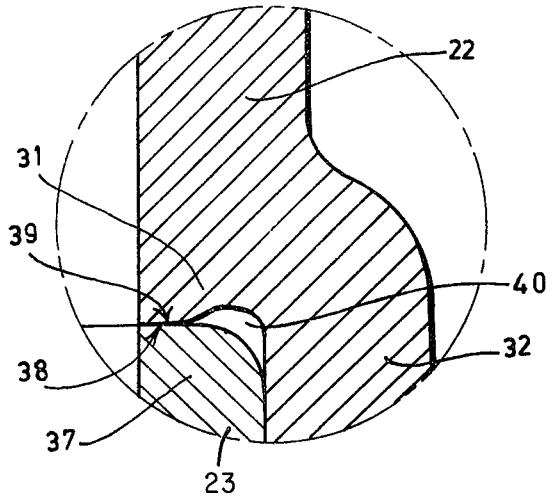
FIG. 3 is a view on an enlarged scale of the portion of FIG. 2 situated within the circle III in FIG. 2.

FIG. 3 shows in an enlarged scale the area lying within the circle III in FIG. 2. The figure shows the transition region 31 of the cylindrical body of the barrel, a portion of the cylindrical wall of the barrel above region 31 and the upper end of the enlarged diameter portion 32 below this region. The upper peripheral portion 37 of the second part 23 is also shown.

As can be seen from FIGS. 2 and 3 the interior surface of the first part 22 comprises an upper cylindrical bore, a lower cylindrical bore provided by the enlarged diameter portion 32, and an annular shoulder 39 provided by the transition region 31, extending between said bores and facing towards the lower, open end of the part 22. The part 23, at its upper peripheral portion 37 provides an annular shoulder 38 facing the first mentioned shoulder 39, the interior surface of the end wall portion of part 23 merging with the adjacent interior surface of the cylindrical bore of part 22, which extends above the transition region.

As will appear later, during manufacture of the container the part 23 is first inserted in the part 22 until the shoulder 38 engages the shoulder 39 and then the part 23 is pressed into the part 22 before the retaining members (discussed hereafter) are inserted. FIG. 3 shows the condition after insertion of part 23 into part 22 but before the part 23 is pressed into the part 22.

As is apparent from FIG. 3 the shoulder 38 of the peripheral portion 37 of part 23 and the shoulder 39 of part 22 make contact at a point (actually a circular line extending circumferentially of the barrel) which is spaced inwardly with respect to the enlarged bore of the enlarged diameter portion 32, and diverge towards the latter at an acute angle. A circumferential groove 40 is formed in the shoulder 39 adjacent its junction with the enlarged bore of part 32. When the end part 23 is pressed with force into the body 22 of the barrel the surfaces 38 and 39 will be elastically deformed slightly, so that a proper surface sealing is obtained.

During manufacture, the bores 35 are formed in the part 22 and the bores 36 formed in the part 23, before the parts are fitted together. The bores 35 are formed at regular angular intervals around the longitudinal axis of the body 22, at equal distances from the shoulder 39 and the bores 36 are formed at identical angular intervals around the longitudinal axis of the part 23, the bores all being at a distance from the shoulder 38 which is slightly greater than the distance of bores 35 from shoulder 39.

Figure 4:
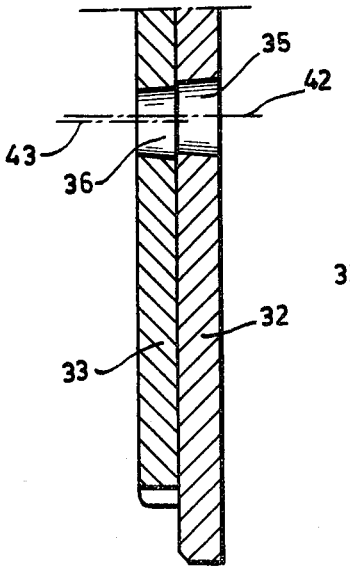
FIG. 4 is a view, on an enlarged scale, in section through a portion of the container during assembly at a location where a retaining member in the form of a tapering sleeve is to be inserted.
Figure 5:
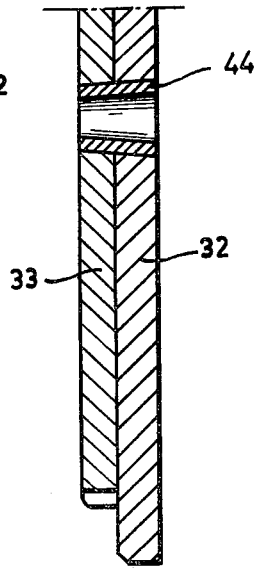
FIG. 5 is a corresponding section after the sleeve has been inserted.

As is clear from the FIG. 4 the bores 35 and 36, and the portions 32 and 33, respectively are formed in such a way that, when the part 23 is disposed within the part 22, but no additional force is exerted on the part 23, the centerline 42 of each bore 35 is spaced slightly upwards from the centerline 43 of the corresponding bore 36. As shown in FIG. 5, each retaining member 44 is in the form of a conically tapering hollow sleeve 44, the bores 35 and 36 being correspondingly tapered. The offset between the bores 35 and 36 in the state shown in FIG. 4 is small enough to allow the sleeve 44 to be inserted through bore 35 and for some distance into bore 36 without exerting force. When the sleeve 44, which is manufactured from hard material, e.g., metal, is driven fully home into the two bores 35 and 36 the portion 33 is slightly pressed upwardly whereby the shoulder 38 is pressed with force against the shoulder 39 and the aforementioned effect is produced.

The manufacture and assembling of the beer barrel is as follows.

The parts 22 and 23 are separately manufactured. Prior to inserting the end part 23 into the body 22 of the vessel, the enlarged end portion 32 of the latter is heated to a temperature ranging from 70° to 90°C, whereupon the part 23, which if need be is previously cooled, is located in position within the portion 32, obviously in such a position that the bores 35 and 36 of the enlarged end two parts register. Beforehand the cooperating surfaces of the two parts were covered with glue, if desired. Thereupon the steel sleeves 44 are placed. The presence of these sleeves and the shrinkage of the part 32 during the cooling ensures a flawless sealing between the two parts and as a consequence of the close fit of the parts a sufficient strength of the barrel at the location of the junction of these two parts. The groove 40 receives excess glue.

Within the scope of the invention various variations are possible. So is it, e.g., possible to provide for an extra interconnection of the cooperating parts by using a glue; in that case a sealing joint can serve to prevent that excess glue penetrates into the container. The parts may also be interconnected by inductive heating using a conductor imbedded in the parts, or by using a suitable solvent. It is also possible to use a friction weld process in which the parts pressed together with a predetermined force, oscillate with respect to each other over a limited angle, the heat, generated thereby, welding together the parts.

An extra fixation of the parts with respect to each other may be obtained by deforming one or both of the parts after assembly thereof. It is e.g., possible to form a peripheral groove into the inner surface of the enlarged diameter portion 12 and roll the still warm material of the end portion 3 therein. Furthermore, after assembling, the edges of the elements 3 and 12 respectively can be bent over inside during a simultaneous heating of these parts.

What I claim is:

1. Pressure barrel, particularly a beer barrel, comprising a first part made of plastics in the form of a vessel open at one end and having a peripheral wall, and a second part, also of plastics, fitted sealingly in said open end of said first part and forming a closure for said open end, the peripheral wall of the first part having an intermediate portion and an enlarged diameter cylindrical portion;

said intermediate portion merging radially with said enlarged diameter portion near said open end and forming an internal annular shoulder facing said open end;

said second part including an end wall portion and a cylindrical peripheral wall at the periphery of said end wall portion, said enlarged diameter portion of said first part receiving with a close fit therein the cylindrical peripheral wall of the second part to obtain a sealed transition between the shoulder and the opposed peripheral edge of the end wall portion, and a number of supersonic welds distributed circumferentially along and interconnecting the enlarged diameter cylindrical portion of the first part and the cylindrical peripheral wall of the second part, wherein said shoulder and said opposed peripheral edge of said end wall portion are axially separated by an undercut space and including a sealing ring compressably sandwiched axially in said space.

2. Barrel according to claim 1, wherein said shoulder of the first part is directed upwardly and outwardly and said opposed peripheral edge of the end wall portion of the second part is directed outwardly and downwardly so as to define an acute angle therebetween.

3. Pressure barrel, particularly a beer barrel, comprising a first part made of plastics in the form of a vessel open at one end and having a peripheral wall, and a second part, also of plastics, fitted sealingly in said open end of said first part and forming a closure for said open end, the peripheral wall of the first part having an intermediate portion and an enlarged diameter cylindrical portion;

said intermediate portion merging radially with said enlarged diameter portion near said open end and forming an internal annular shoulder facing said open end;

said second part including an end wall portion and a cylindrical peripheral wall at the periphery of said end wall portion, said enlarged diameter portion of said first part receiving with a close fit therein the cylindrical peripheral wall of the second part to obtain a sealed transition between the shoulder and the opposed peripheral edge of the end wall portion, and a number of supersonic welds distributed circumferentially along and interconnecting the enlarged diameter cylindrical portion of the first part and the cylindrical peripheral wall of the second part, wherein the two parts are interconnected by means of glue applied to the axially opposed faces of said shoulder and peripheral edge, a circumferential groove being formed in one of said axially opposed faces at some distance from the interior of said vessel.

4. Pressure barrel, particularly a beer barrel, comprising a first part made of plastics in the form of a vessel open at one end and having a peripheral wall, and a second part, also of plastics, fitted sealingly in said open end of said first part and forming a closure for said open end, the peripheral wall of the first part having an intermediate portion and an enlarged diameter cylindrical portion;

said intermediate portion merging radially with said enlarged diameter portion near said open end and forming an internal annular shoulder facing said open end;

said second part including an end wall portion and a cylindrical peripheral wall at the periphery of said end wall portion, said enlarged diameter portion of said first part receiving with a close fit therein the cylindrical peripheral wall of the second part to obtain a sealed transition between the shoulder and the opposed peripheral edge of the end wall portion, and a number of supersonic welds distributed circumferentially along and interconnecting the enlarged diameter cylindrical portion of the first part and the cylindrical peripheral wall of the second part, wherein the inner face of said enlarged diameter cylindrical portion of the first part and the outer face of said cylindrical peripheral wall of the second part taper slightly toward said shoulder.

5. A pressure barrel, useable as a beer barrel, comprising:

a hollow body of plastics material open at one end, and having a peripheral wall, said peripheral wall including a substantially cylindrical intermediate portion and cylindrical end portion of enlarged internal diameter defining said open end, said intermediate and enlarged diameter end portions radially merging and thereby forming an annular interior shoulder at the end of said intermediate portion and which faces said open end;

an end closure of plastics material for fitting sealingly in said open end, said end closure including an end wall portion and a cylindrical peripheral wall portion recessed in radially close fitting relation within said cylindrical end portion of said body, said end closure having an annular peripheral edge in axially opposed contact with said shoulder in sealed relation therewith;

a first set of holes through and distributed circumferentially around said enlarged diameter cylindrical end portion of said body;

and a second set of holes through said cylindrical peripheral wall portion of said end closure, and at the same circumferential locations as the holes of the first set;

means axially compressively preloading and elastically deforming said axially opposed and contacting annular peripheral edge and shoulder for providing said sealing relation therebetween and comprising a partial axial offset of said second set of holes from said first set of holes toward said open end and a set of relatively hard tapered sleeves corresponding in size to said holes and each drivingly received through circumferentially aligned holes of the first and second sets to axially align same.

6. Barrel according to claim 5 in which the axially opposed faces of said peripheral edge and shoulder, when undeformed, taper slightly axially away from each other radially outwardly from the interior of the barrel and in which the radial extent of contact therebetween is a function of said axial compressive preloading thereon and of said axial offset of said sets of holes.

7. A pressure barrel, useable as a beer barrel, comprising:

a hollow body of plastics material open at one end, and having a peripheral wall, said peripheral wall including a substantially cylindrical intermediate portion and cylindrical end portion of enlarged internal diameter defining said open end, said intermediate and enlarged diameter end portions radially merging and thereby forming an annular interior shoulder at the end of said intermediate portion and which faces said open end;

an end closure of plastics material for fitting sealingly in said open end, said end closure including an inwardly concave end wall portion and a cylindrical peripheral wall portion received in radially close fitting relation within said cylindrical end portion of said body, said end wall and peripheral wall portions of said end closure merging at the interior end of said end closure to form an annular peripheral edge axially opposing said shoulder in sealed relation therewith, the interior surfaces of said intermediate portion of said body peripheral wall and said concave end wall portion being interior surfaces of said pressure barrel and establishing a smooth substantially continuous profile across the annular seal area defined by the opposed shoulder and closure peripheral edge;

circumferentially spaced means radially mechanically interlocking said body enlarged diameter portion to said closure

8. Barrel according to claim 7 in which the opposed faces of said annular shoulder and closure peripheral edge slope axially away from each other toward the outside of the barrel in an undercut manner, and including an annular sealing means axially forceably sandwiched between said shoulder and closure peripheral edge and extending radially into the outer undercut area therebetween.

9. Barrel according to claim 8 in which said annular sealing means is a sealing ring axially spacing the shoulder and closure peripheral edge and compressed axially to an extent in the range of 15 to 35% from its uncompressed state wherein the extent of compression is selectable to eliminate significant volume variations between finished barrels.

10. Pressure barrel, particularly a beer barrel, comprising a first part made of plastics in the form of a vessel open at one end and having a peripheral wall, and a second part, also of plastics, fitted sealingly in said open end of said first part and forming a closure for said open end, the peripheral wall of said first part having an intermediate portion and an enlarged diameter cylindrical portion;

said intermediate portion merging radially with said enlarged diameter portion near said open end and forming an internal annular shoulder facing said open end;

said second part including an end wall portion and a cylindrical peripheral wall at the periphery of said end wall portion, said enlarged diameter portion of said first part receiving with a close fit therein the cylindrical peripheral wall of the second part to obtain a sealed transition between the shoulder and the opposed peripheral edge of the end wall portion, and a number of supersonic welds distributed circumferentially along and interconnecting the enlarged diameter cylindrical portion of the first part and the cylindrical peripheral wall of the second part, wherein said interconnecting wells consist of circumferentially distributed weld holes extending radially through said enlarged diameter portion and thus opening to the opposed face of said cylindrical peripheral wall of said end enclosure, said last mentioned face having a weld portion coaxial with each said weld hole and accompanied by at least some surface deformation, the plastic material of said body and end closure being comingled in the region of said weld hole and weld portion to form a said weld.

* * * * *